United States Patent [19]

Tietge et al.

[11] Patent Number: 4,584,733

[45] Date of Patent: Apr. 29, 1986

[54] SPA OR POOL CLEANING DEVICE

[75] Inventors: Fred R. Tietge, San Diego; Ronald J. Sargent, Escondido, both of Calif.

[73] Assignee: Saresearch Corporation, Escondido, Calif.

[21] Appl. No.: 682,747

[22] Filed: Dec. 17, 1984

[51] Int. Cl.[4] ..... E04H 3/20

[52] U.S. Cl. ..... 15/1.7; 15/341

[58] Field of Search ..... 15/1.7, 341; 210/169, 210/207

[56] References Cited

U.S. PATENT DOCUMENTS

| | | | |
|---|---|---|---|
| 610,279 | 9/1898 | Ricketts | 15/1.7 |
| 954,260 | 4/1910 | Davis | 15/341 |
| 3,820,182 | 6/1974 | Vockroth | 15/1.7 |
| 4,094,031 | 6/1978 | Cellini | 15/1.7 |

*Primary Examiner*—Edward L. Roberts

*Attorney, Agent, or Firm*—Charmasson & Holz

[57] ABSTRACT

A self-contained hand operated device for cleaning spas, pools and the like of debris comprises an elongated tube having an open lower end and a piston slidably mounted in the tube for drawing water and debris in through the lower end. A piston rod projects upwardly out of the tube and is connected to a handle for manual operation of the piston. A filter for removing debris from water drawn into the tube is provided, and a one-way check valve traps debris in the filter. The piston includes a one-way valve for allowing water to flow past it during each downstroke of the piston. An exit passageway for water trapped in the upper part of the tube is provided which directs water ejected during each upstroke in a direction towards the lower end of the device and has exit openings adjacent a lower part of the tube.

9 Claims, 9 Drawing Figures

SPA OR POOL CLEANING DEVICE

BACKGROUND OF THE INVENTION

The present invention relates to a hand-operated device for cleaning the bottom and surface of pools, spas, ponds, aquariums, and the like of submerged or floating debris such as leaves, twigs, pebbles, loose dirt, silt and sand or dropped items such as paper, buttons, and so on.

Vacuum and filtration apparatus for cleaning swimming pools and the like tends to be complex, bulky and relatively expensive to operate. It is not particularly efficient or convenient for removing loose relatively heavy debris from the surface or bottom of pools, or for cleaning small pools such as spas or ponds.

Hand operated water cleaning devices have been used in the past for cleaning small volumes of water such as those found in tanks or cisterns. One such device is described in U.S. Pat. No. 1,101,541 of Harrington, where a hand operated piston is slidable in a tube to draw water and debris in through a one-way valve in the lower end of the tube, and to expel debris and water through an opening in the upper end of the tube.

A similar device for cleaning swimming pools is described in U.S. Pat. No. 4,094,031 of Cellini, where a hand operated vacuum inducing device draws water and debris in through the lower end of a tube. Debris is trapped in the lower end of the tube by a one-way valve which has openings to allow water to drain out of the tube. Debris is removed by taking the tube out of the water and releasing a sliding door in the bottom of the tube. Thus the device is fairly slow to operate and must be repeatedly removed from the water to return water to the pool and remove debris from the tube.

In U.S. Pat. No. 3,820,182 of Vockroth a hand operated vacuum cleaning device for pools is described in which a piston is slidable in a barrel. A one-way valve traps debris in the liner, while water is drawn up the tube during the upstroke of a piston through a second one-way valve. In the downstroke of the piston water trapped above the second valve is forced through a one-way valve in the piston into an upper chamber in the barrel. In the subsequent upstroke water in the upper chamber is ejected through an opening in the chamber. Thus debris is removed by reciprocating the pump while moving the tube across the bottom of the pool. This device is relatively complex, since three one-way or check valves are involved, and water is therefore expelled in a three stage process. The device will become ineffective when the sieve or liner is clogged with debris so that suction is limited. Thus the device must be taken apart at periodic intervals to clean the liner; and it will be difficult to tell exactly when the water liner needs cleaning. Since water is ejected repeatedly through an opening in the upper part of the barrel, the water surface will be continuously disturbed by splashing and/or turbulence. This will make it difficult for the user to see the bottom of the pool, both to judge whether or not the device is still operating effectively and to see debris to be removed.

Thus in all of the known hand operated vacuum devices there are problems in effectively removing debris from volumes of water. In the Harrington and Cellini devices the tubes must be repeatedly removed from the water to expel debris and water trapped in the tube. In the Vockroth device it will be difficult to judge when the strainer needs cleaning and the disturbance of the water surface will significantly reduce visibility so that the user may not be able to see debris remaining in the pool.

SUMMARY OF THE INVENTION

It is an object of the present invention to provide a self-contained hand-operated cleaning device for volumes of water such as pools, spas, and the like which is relatively easy to operate and which creates relatively little disturbance of the water during operation to improve visibility of the bottom of the pool.

According to the present invention a hand operated device for cleaning pools, spas and the like of loose debris is provided, which comprises an elongated tube having an open lower end, a piston slidably mounted in the tube for drawing water and debris in through the open lower end, and a manually operable member connected to the piston for reciprocating the piston in the tube. An easily removable large area tubular strainer or filter is mounted by a non-elastic trapping means in the tube for straining debris from water sucked into the tube, and a one-way check valve is provided for trapping debris in the strainer. The piston includes a one-way valve which is closed during each upstroke of the piston and is forced open during each downstroke to allow water trapped below the piston to flow past the piston into an upper part of the tube above the piston. An exit passageway for water from the device is connected to the upper part of the tube such that water is forced out via the exit passageway during each upstroke of the piston. The exit passageway directs water towards the lower end of the device and has exit openings adjacent a lower part of the tube which are preferably arranged in an annular ring around the tube to reduce the water discharge velocity and thus reduce disturbance of the surrounding water.

In the preferred embodiment the exit passageway is provided by an outer sleeve mounted on the tube and communicating with the upper part of the tube at its upper end. Exit openings are provided at the lower end of the sleeve, and are preferably directed downwardly so as to direct ejected water in a downwards conical pattern at a 45° angle. This diffuses and reduces the water discharge velocity, so that there is little disturbance of the surrounding water and debris to be ingested, when the device is used to clean the bottom of a pool. Furthermore, it allows substantially clear viewing of the bottom of the pool throughout the cleaning operation. Straight down, or zero angle with the tube axis, maximizes discharge velocity and bottom disturbance. As much as 90° to the tube axis minimizes discharge velocity and bottom disturbance, but would wet the users feet or legs when used in shallow water. Therefore, a 45° discharge angle is a good compromise of all considerations.

The area of the tube surrounding the filter or strainer is preferably at least partly transparent to allow the user to see when the filter becomes full. The filter is preferably in the form of a bag of translucent material so that the contents of the bag are visible and the user can see when the bag needs replacing or cleaning. The bag is releasably mounted in the tube.

An adapter device is preferably releasably mounted at the lower end of the tube for attaching a duplex snout or nozzle to the tube in either of two positions. The nozzle has a wider opening at one end and a narrower opening at the other end, and can be attached with its narrower opening pointing downwards for cleaning the bottom of a pool, and reversed with its wider opening pointing downwards for cleaning the surface of a pool, for example.

DESCRIPTION OF THE PREFERRED EMBODIMENT

Figure 1:
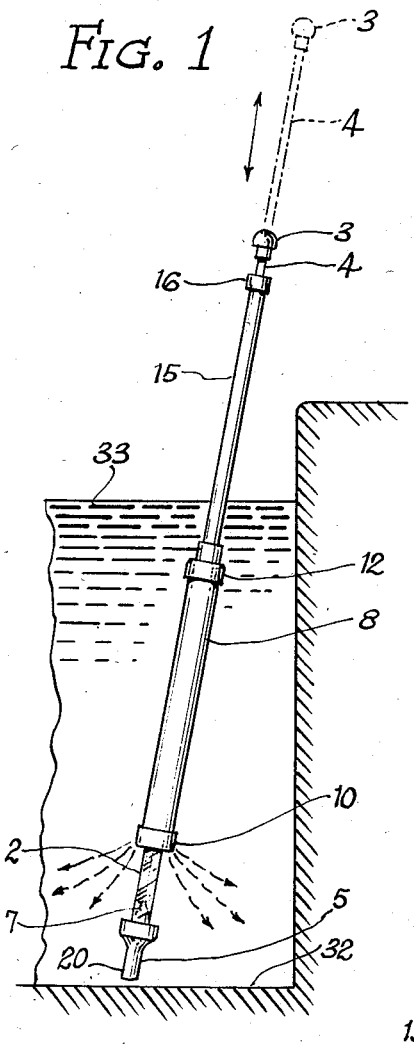
FIG. 1 shows a pool or spa cleaning device according to a preferred embodiment of the invention in operation in a pool, spa, or other body of water.

A hand operated cleaning device according to a preferred embodiment of the invention for cleaning volumes of water such as pools, spas, ponds and the like of debris such as dirt, sand, pebbles, leaves, and so on is illustrated in the drawings.

Figure 2:
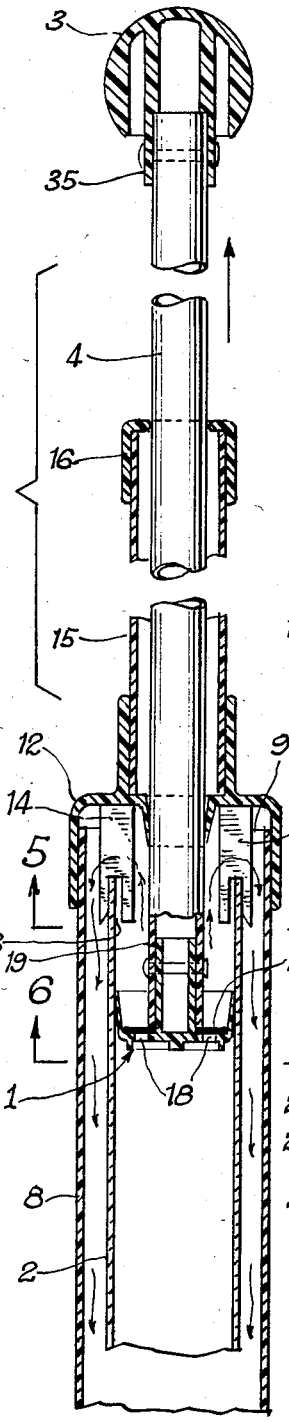
FIG. 2 is a vertical cross-section through an upper part of the cleaning device.
Figure 3:
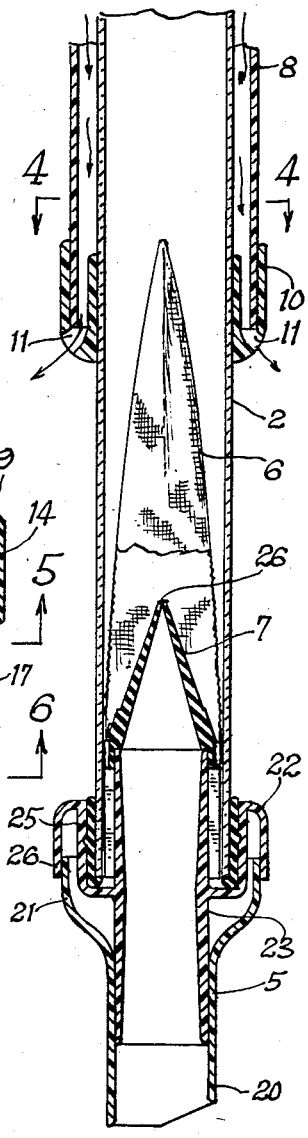
FIG. 3 is a vertical cross-section through a lower part of the cleaning device.

The device basically operates in the manner of a vacuum pump or syringe, and as shown in FIGS. 1 to 3 it comprises a piston 1 slidable in an elongated tube 2 and connected to a handle 3 via connecting piston rod or tube 4 projecting out of the upper end of the tube 2. The piston is slidable axially in the tube by reciprocating the handle 3 between the solid and dotted line positions shown in FIG. 1 and creates a vacuum in its upstroke to draw water and debris into the tube via a nozzle 5 mounted on the lower end of the tube 2.

As best shown in FIG. 3, a strainer or filter bag is mounted in the lower end of the tube 2 so as to strain debris from water drawn into the tube. A one-way check valve 7 is mounted in the lower end of the strainer bag 6 to trap strained debris in the bag.

As best shown in FIGS. 2 and 3, an outer sleeve member 8 is mounted over the tube 2 so as to enclose its open upper end 9. The sleeve member defines an exit passageway for water trapped in the upper end of the tube, as will be described below, and includes a connecting ring 10 for connecting its lower end to a lower part of the tube 2.

Figure 4:
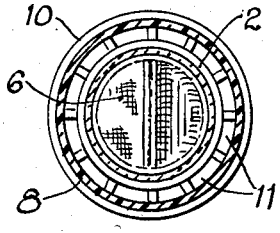
FIG. 4 is a horizontal cross-section on the lines 4—4 of FIG. 3.
Figure 5:
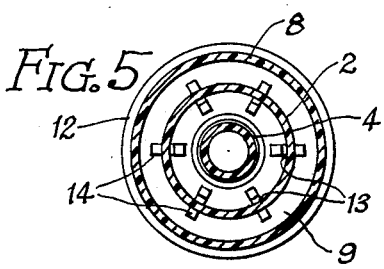
FIG. 5 is a horizontal cross-section on the lines 5—5 of FIG. 2.

Connector ring 10 has a series of downwardly directed openings 11 around its circumference (see FIG. 4), the sleeve member 8 is in slidable sealing engagement with the piston rod 4 at its upper end via connecting ring seal 12. As best shown in FIG. 5, the upper end of the tube 2 is retained in a series of recesses 13 in flanges 14 projecting downwardly from connecting ring 12. As best shown in FIGS. 2 and 5, a series of flanges 34 projecting downward from connecting ring 12 act as up stops for the piston 1 and rod 4 assembly. Similarly, the tubular section 35 of handle 3 acts as a down stop for the piston 1 and rod 4 assembly.

As illustrated in FIG. 2, the piston rod 4 projects upwardly through a further tube or sleeve 15 which is mounted at its lower end in connecting ring 12. The sleeve 15 has an upper connecting ring or guide 16 mounted at its upper end which is in slidable engagement with the piston rod 4, thus adding to the stability of the piston action. The length of tubular assembly comprising tube 2, outer sleeve member 8 and upper tube or sleeve 15 is arranged according to the depth of the volume of water to be cleaned and the total area of water, such that the upper end of the assembly is normally above the water level, as shown in FIG. 1, even when the center of a pool is cleaned.

Figure 6:
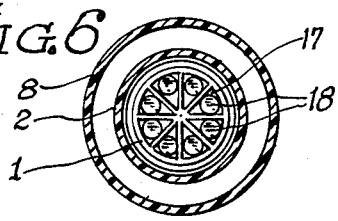
FIG. 6 is a horizontal cross-section on the lines 6—6 of FIG. 2.

As best shown in FIGS. 2 and 6, the piston 1 includes a one-way valve 17 comprising an annular ring seal which is arranged to close during each upstroke of the piston to seal it and is forced open during each downstroke of the piston. The piston has a series of openings 18 (see FIG. 6) which are opened by displacement of the seal 17 during each downstroke to allow water to flow past the piston into the upper part of the tube above the piston. In the subsequent upstroke the piston is again sealed so that water is drawn in through the lower end of the tube while at the same time water trapped above the piston will be forced out via the exit passageway comprising the open upper end 9 of the tube, the spacing between the outer sleeve member and the tube, and exit openings 11 at the lower end of the sleeve member, as shown by the arrows in FIGS. 2 and 3.

The piston 1 is best illustrated in FIG. 2 and comprises an inverted cap member with a projecting rod projecting into and secured to piston rod 4. The seal or valve 17 suitably comprises an annular gasket of resilient material, suitably of soft neoprene, slidably mounted on piston 1 over the openings 18, and trapped by the piston rod 4, and arranged to be forced up by the pressure of water in each downstroke of the piston.

Tube 2 is of transparent material to allow strainer or filter bag 6 to be visible. The bag 6 is itself of translucent material to allow the user to judge when it needs to be emmptied or replaced.

Figure 7:
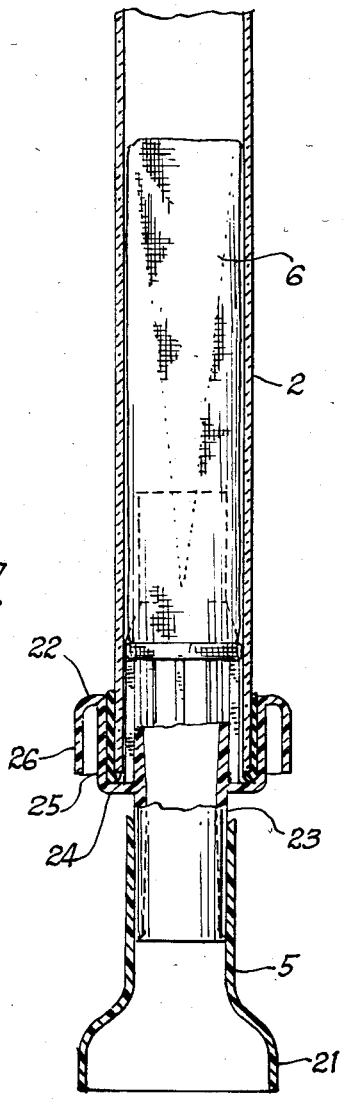
FIG. 7 is a horizontal cross-sectional view similar to FIG. 3 showing the nozzle of the device in a reversed position.

The nozzle 5 is reversible as illustrated in FIGS. 3 and 7 and includes a narrower opening 20 at one end for bottom cleaning and a wider opening 21 at the other end for surface cleaning. An adapter device 22 at the lower end of the tube 2 is arranged to secure the nozzle to the tube in either of the two positions shown in FIGS. 3 and 7. The adapter device 22 also comprises a mounting and retaining device for the check valve 7 and filter bag 6, as will be described in more detail below.

The adapter device 22 basically comprises a cylindrical member 23 projecting into the lower end of the tube 2 which has an annular ring 24 with an upstanding rib or flange 25 which is a snap fit over the open lower end of the tube. The rib or flange 25 has a downturned rim 26 for retaining the wider end 21 of the nozzle in the position shown in FIG. 3. On the upper outside diameter of cylinder 23, there are six longitudinal ribs 29 that act as stops for both the check valve 7 and the filter ring 31. The narrower end 20 of the nozzle is a sliding taper fit over the lower end of the cylindrical member in either of the positions shown in FIGS. 3 and 7.

Figure 8:
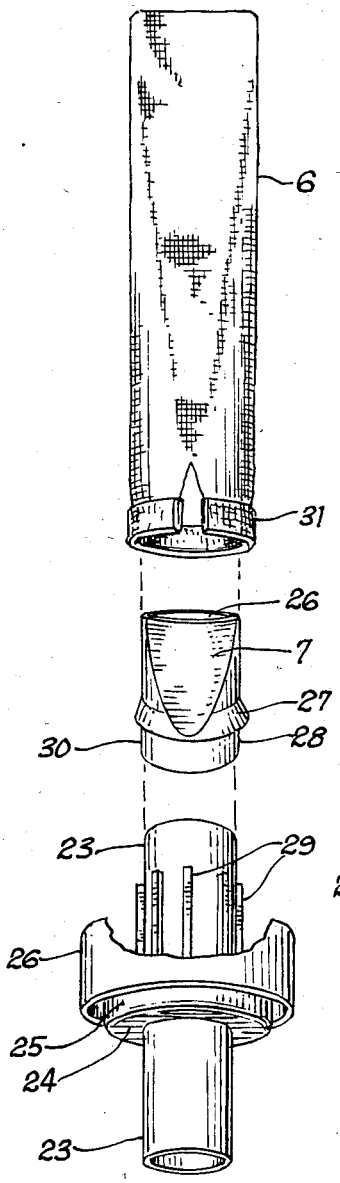
FIG. 8 is a front elevational view of the strainer bag and bag mounting device taken apart.
Figure 9:
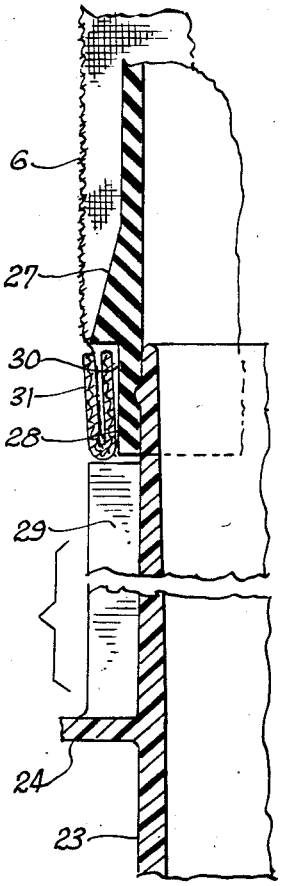
FIG. 9 is a partial vertical section illustrating the connection of the strainer bag to the bag mounting device.

As shown in FIGS. 3, 7 and 8, the check valve 7 comprises a flattened conical valve member of flexible material with an upper opening 26 which will be widened by and during the suction of water and debris upwards through the valve. The valve member has a flared skirt 27 and a lower cylindrical part 28 (see FIG. 8). An annular retaining space 30 is defined by the ribs 29 on the upper end of cylinder 23 and the flared skirt 27. A split retainer ring 31 for the open end of the bag 6 is a slip on fit in the groove 30, as shown in FIGS. 7 and 9. The upper end of the adapter device projects into the lower end of the valve 7. Thus when the parts are assembled together as shown in FIGS. 3 or 7 the filter bag is integrally trapped in the groove 30 by the surrounding wall of the tube 2.

When the filter bag 6 needs to be emptied or replaced, the adapter device 22 is simply pulled off the end of the tube 2, carrying the valve 7 and filter bag 6 with it. The bag retaining ring 31 can then be simply slipped off the valve 7 into the pulled apart position shown in FIG. 8, and either be emptied or replaced. Thus no separate means for holding the filter bag in the tube is required, such as clamps, pins or elastic, which would make disassembly more difficult.

The operation of the pool or spa cleaning device will now be described in more detail. In order to remove debris such as leaves, twigs, small pebbles, sand and the like from the bottom of a pool or other body of water, the nozzle 5 will be positioned as shown in FIGS. 1 and 3 with its narrower end 20 downwards.

The device will then be positioned in the pool as shown in FIG. 1, with the nozzle at the bottom 32 of the pool. The piston is then moved up and down using the handle 3, which is spherical for easy gripping.

During each upstroke of the piston, water and debris adjacent the nozzle 5 will be drawn into the tube 2. The debris will be trapped in filter bag 6. In the subsequent downstroke of the piston, piston valve 17 will be forced upwards to open the piston openings 18 and allow the piston 1 to move unobstructed through the water trapped in the tube. During the next upstroke of the piston water trapped above it in this manner will be forced out of the device along the exit passageway defined by the open upper end of the tube 2, the spacing between the outer sleeve member and the tube 2, and the exit openings 11 in the connecting ring 10. This passageway is illustrated by the arrows in FIGS. 2 and 3. Since the openings 11 are directed downwardly and outwardly the water is ejected in a downward conical pattern, as illustrated by the arrows in FIG. 1.

The openings 11 are positioned to be well below the surface 33 of the water when the device is used to clean the bottom of a pool. The positioning of the openings and the conical pattern of the ejected water serve substantially to minimize the disturbance of the surrounding water so that relatively good visibility to the bottom of the pool is maintained during operation of the device, and the debris to be ingested is not scattered. This is important since if the water surface were disturbed by splashing or if the water itself were disturbed to any great extent by turbulence, the user of the device would be unable to see the bottom of the pool in order to check if debris had been picked up by the device or to see where debris remained to be picked up. The openings 11 are preferably inclined at approximately 45° so as to direct ejected water in a substantially 45° conical pattern, to reduce, minimize, or attenuate the ejection velocity and thus the subsequent turbulence in the surrounding water.

When debris floating on the top of the water is to be picked up, the nozzle 5 is reversed and the device positioned with the nozzle over the debris. The nozzle with debris trapped in it is submerged slightly to minimize air ingestion. The piston is then reciprocated in a similar manner to draw the debris and surrounding water into the tube. Water will be ejected from the openings 11 in a conical pattern in the same way as when the device is operated underwater. The downwardly directed conical pattern of ejected water will produce less splashing than a single stream of ejected water, and since it will be fairly close to the water surface there will be little chance of the user being splashed.

The device can be used effectively until the filter bag becomes full. This condition will be seen by observation through the exposed portion of the transparent tube surrounding the bag and the filter bag can easily be removed and cleaned or replaced when necessary as described above.

The various lengths of the tubular parts of the device are chosen according to the average dimensions of the pools, spas, or other bodies of water to be cleaned. Add-on or replacement tubular parts may be provided to lengthen the device when a larger size pool is to be cleaned. Suitable telescopic or modular extension members for lengthening the piston rod 4 and upper tube 15 may also be provided.

Thus this device provides a relatively simple, inexpensive, and easy to use tool for cleaning spas, pools and the like.

The various parts of the pool or spa cleaning device are preferably of plastics material so that there will be no corrosion or rusting problems from continuous underwater use. The piston and piston rod seals 12 and 1 are each one-piece integral designs.

The cleaning device described above is totally self-contained for easy manual operation and requires no additional hookups, nets or hoses. The pump or piston action is balanced, since the axial vacuum force produced during each upstroke of the piston tends to pull water and debris into the device while at the same time thrusting water out via the exit openings 11. Thus the input vacuum force is balanced by the thrust of the exiting filtered water. The operation will therefore be relatively smooth.

It is relatively easy to remove the filter bag when replacement of the bag is necessary since the adapter device is a snap-on, snap-off fitting, and the bag is free more or less to fall off in the user's hand when pulled out for cleaning or replacement. Thus no twisting, turning or special alignment is required to replace the filter bag.

The discharged filtered water is diffused annularly from the device, thus substantially minimizing the disturbence of the surrounding water and substantially maintaining continuity of vision in the vessel being cleaned.

While the invention has been particularly shown and described with reference to the preferred embodiment, it will be understood that modifications can be made to the disclosed embodiment without departing from the scope of the invention, which is defined by the appended claims.

What is claimed is:

1. A totally self-contained hand operated device for cleaning the bottom and surface of bodies of water such as spas, pools, ponds and acquariums of debris, the device comprising:

an elongated tube having an open lower end;

a piston slidably mounted in the tube for drawing water and debris in through the open lower end;

means connected to the piston for reciprocating the piston in the tube;

strainer means mounted in the lower part of the tube for straining debris from water drawn into the tube;

a one-way check valve for trapping strained debris in the strainer means;

the piston including a one-way valve movable between a closed position during each upstroke of the piston and an open position during each downstroke of the piston for allowing water to flow past the piston during each downstroke of the piston;

an outer sleeve mounted coaxially around the tube and defining an evacuation chamber having means for expelling water near the lower part of the tube; and means defining an exit passageway for water from the upper end of the tube and into said evacuation chamber.

2. The device as claimed in claim 1, wherein said means for expelling comprises a series of radially-oriented exit openings.

3. The device as claimed in claim 2, wherein the exit openings are directed downwardly at an inclined angle to direct water in a downward conical pattern.

4. The device as claimed in claim 3, wherein the openings are inclined at substantially a 45° angle.

5. The device as claimed in claim 4, wherein said means defining an exit passageway comprises a connecting ring capping the sleeve and enclosing the upper end of the tube; and said means for reciprocating comprising an elongated piston rod connected to said piston and projecting upwardly through the upper end of the connecting ring, and a handle connected to the free end of the piston rod.

6. The device as claimed in claim 1, wherein the lower part of the tube surrounding the strainer means is at least partially transparent to allow the strainer means to be seen by the user.

7. The device as claimed in claim 6, wherein said strainer means comprises a filter bag of translucent material releasably mounted in the lower end of the tube.

8. A totally self-contained hand operated device for cleaning the bottom and surface of bodies of water such as spas, pools, ponds and acquariums of debris, the device comprising:

an elongated tube having an open lower end;

a piston slidably mounted in the tube for drawing water and debris in through the open lower end;

means connected to the piston for reciprocating the piston in the tube;

strainer means mounted in the lower part of the tube for straining debris from water drawn into the tube;

a one-way check valve for trapping strained debris in the strainer means;

the piston including a one-way valve movable between a closed position during each upstroke of the piston and an open position during each downstroke of the piston for allowing water to flow past the piston during each downstroke of the piston;

means defining an exit passageway for water from the tube connected to the upper part of the tube and including means for directing water towards the lower end of the device, the exit passageway having at least one exit opening for water adjacent the lower part of the tube; and a nozzle reversably mounted on the lower end of the tube, the nozzle having a wider opening at one end and a narrower opening at the other end.

9. The device as claimed in claim 8, including adapter means releasably mounted on the end of the tube for reversibly mounting the nozzle on the end of the tube, the adapter means including means projecting into the open end of the tube for releasably mounting the check valve and strainer means in the tube.

* * * * *